United States Patent [19]

Ranft

[11] 4,384,467

[45] May 24, 1983

[54] METHOD OF FORMING RINGS

[75] Inventor: Eberhard Ranft, Houston, Tex.

[73] Assignee: Raymond International Builders, Inc., Houston, Tex.

[21] Appl. No.: 278,561

[22] Filed: Jun. 29, 1981

[51] Int. Cl.[3] ..... B21D 9/05; B21F 37/00

[52] U.S. Cl. ..... 72/131; 72/149; 72/217; 140/88

[58] Field of Search ..... 29/148.4 C, 149.5 R, 29/149.5 C, 159.1, 417; 72/129, 131, 132, 149, 203, 217, 294, 316, 387, 388; 140/88

[56] References Cited

U.S. PATENT DOCUMENTS

| | | | |
|---|---|---|---|
| 3,580,030 | 5/1971 | Bean et al. | 72/149 X |
| 3,661,002 | 5/1972 | Peddinghaus | 72/217 X |
| 4,132,106 | 1/1979 | Bihler | 72/149 X |

*Primary Examiner*—Ervin M. Combs

*Attorney, Agent, or Firm*—Fitzpatrick, Cella, Harper & Scinto

[57] ABSTRACT

A method and apparatus for forming rings that is particularly suited for forming plow rings from elongated lengths of stock having irregular cross sectional shape. A length of stock (12) is positioned against a mandrel (20), the end of the stock being pre-bent from a previous bending operation, with the free end of the stock extending beyond the mandrel. A movable bending element (24) is brought into contact with the stock opposite the point of contact with the mandrel, and advanced around the mandrel partially bending the stock. A clamp (82) clamps the partially bent stock against the mandrel and a cutter (98) then cuts the stock, leaving a partial bend in the newly formed free end of the stock, the cut portion of stock being clamped to the mandrel. The length of stock is moved away from the mandrel so that the bending of the cut portion around the mandrel can be completed.

7 Claims, 12 Drawing Figures

SOURCE OF PNEUMATIC PRESSURE
MAIN SWITCH
HYDRAULIC POWER UNIT
A-
B+
B-
C+
C-
D-
E+
F+
G+
G-
A+

METHOD OF FORMING RINGS

BACKGROUND OF THE INVENTION

1. Field of the Invention

This invention relates to a method for forming rings such as plow rings on pile shells, by bending lengths of material cut from continuous elongated stock, and to apparatus for carrying out the method.

2. Brief Description of the Prior Art

The present invention is particularly directed to the manufacture of plow rings for pile shells. These plow rings are attached to the lower end of thin tubular pile shells to be engaged by a driving mandrel used to drive the shell into the earth before it is filled with concrete. These plow rings are formed by bending lengths of heavy stock of irregular cross sectional shape and this presents a problem of forming the stock into rings.

It is known to form plow rings by cutting long lengths of stock such as bar, strip or wire material into smaller lengths and then bending the smaller lengths around cylindrical mandrels. However, because of the thickness of the stock and its irregular cross sectional shape it tends to spring back from the mandrel and this makes it difficult to form the rings.

It has been proposed to automate the above described ring forming operations by means apparatus employing a number of mandrels, each mandrel adapted to a different stage in the cutting and bending process. U.S. Pat. No. 4,132,106, for example suggests to use a first partially circular rotatable mandrel in connection with a first bending roller that moves around the mandrel to apply a partial circular bend to a length of stock, as a first clamp secures the stock against movement during the bending. A punch then cuts the stock in the middle of the bend while a second clamp secures the opposite end of the cut length, which had been partially bent in a previous operation cycle, against a second mandrel. A second forming roller is then positioned against the second mandrel which is thereafter rotated to complete the bending operation, and the completed ring is removed. The now pre-bent end of the stock is advanced by an amount corresponding to the circumference of the ring and the operation is repeated.

U.S. Pat. No. 3,580,030 proposes a somewhat similar technique but using a first mandrel for curving both ends of each cut length of stock and a second mandrel for subsequently curving the center portion.

The known prior art does not solve the problem of forming rings accurately and in a continuous and economical manner.

SUMMARY OF THE INVENTION

The present invention is an improvement over the ring forming devices and methods of the prior art, which eliminates the need for two or more mandrels. According to the present invention a single mandrel and bending element are employed in a novel manner for pre-bending the ends of lengths of stock and for bending the center portion as well. This greatly simplifies the automatic forming of rings and eliminates the various additional rollers, clamps and the like associated with extra mandrels. As a result, the cost of producing such rings is significantly reduced.

According to one aspect of the present invention, a single mandrel is provided that has a peripheral shape corresponding to the interior of the ring to be formed. Stock advancing means are provided to advance a continuous length of ring forming elongated stock lengthwise so that it engages the periphery of the mandrel with the free end of the stock extending beyond the mandrel. A movable bending element is also provided to press the ring forming stock against the mandrel. The bending element is movable around the mandrel to thereby bend the stock according to the mandrel peripheral shape. A clamp is provided for clamping the stock against the mandrel after the stock has been bent part way around the mandrel. A cutter is provided a predetermined location on the mandrel for cutting a length of the partially bent stock from the continuous portion thereof. The thus newly formed free end of the stock contains a bend corresponding to the curvature of the mandrel. A positioning guide is also provided for moving the continuous portion of the stock away from the mandrel so that bending of the cut portion around the mandrel can be completed.

According to a further aspect of the invention, a length of ring forming stock is positioned against the mandrel, the end thereof having been bent in a previous operation cycle. A bending element is positioned against the stock at a first location on the periphery of the mandrel such that the stock is between the bending element and the mandrel. The bending element is advanced around the mandrel past a predetermined cutting location to a second location, thus bending the stock partway around the mandrel. The stock is clamped against the mandrel at a predetermined clamping location between the second location and the cutting location and the stock is then cut at the cutting location. The cut off portion of the severed piece resulting from stock at this point is prebent at both ends and clamped near one end to the mandrel. The bending element then completes the bending of the middle region of the cut-off portion of the stock to form the ring.

The end of the continuous portion of the stock is then moved laterally away from the mandrel to permit the bending element to advance the rest of the way around the mandrel to complete formation of the ring.

The ring thus formed may then be removed and the continuous portion of the stock may be advanced and positioned against the mandrel for another bending cycle, to form a second ring. It will be appreciated that the bending of the stock part way around the mandrel prior to cutting the stock on the mandrel results in the prebending of the end of the continuous portion of the stock for use in forming a subsequent ring. This prebending is particularly advantageous because the bend is formed accurately and easily in this manner. In cases where the end of a straight section of stock must be bent to the curve of a mandrel the bend is particularly difficult to carry out and an excessive amount of springback occurs.

There has been outlined rather broadly the more important features of the invention in order that the detailed description thereof that follows may be better understood, and in order that the present contribution to the art may be better appreciated. There are, of course, additional features of the invention which will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification wherein:

FIGS. 6–11 are diagramatic representations illustrating the successive steps employed in carrying out the method of the present invention.

DETAILD DESCRIPTION OF THE PREFERRED EMBODIMENT

Figure 1:
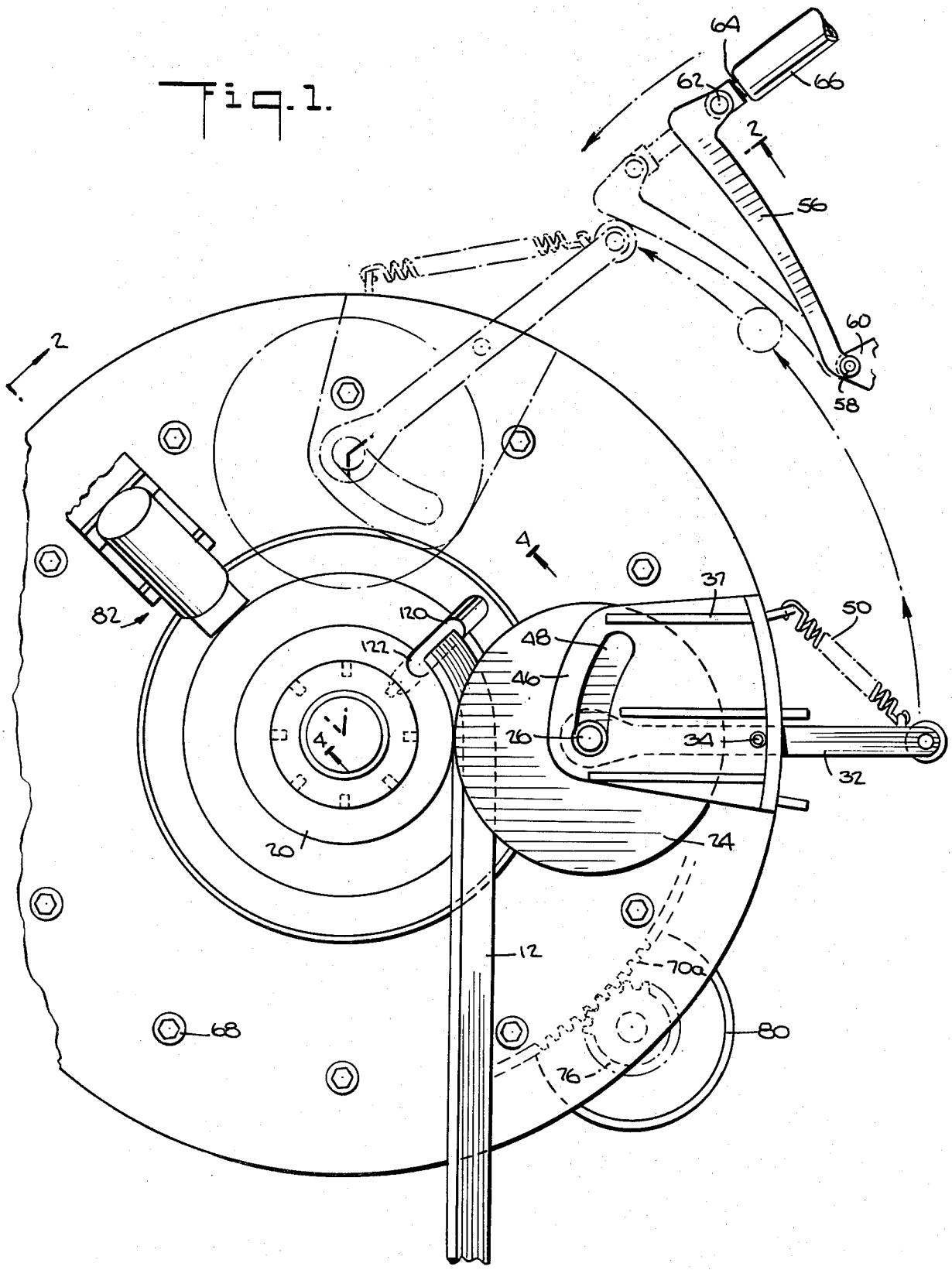
FIG. 1 is a plan view, partially cut away, of a proposed ring forming apparatus constituting a preferred embodiment of the ring forming apparatus of the present invention.
Figures 2, 5:
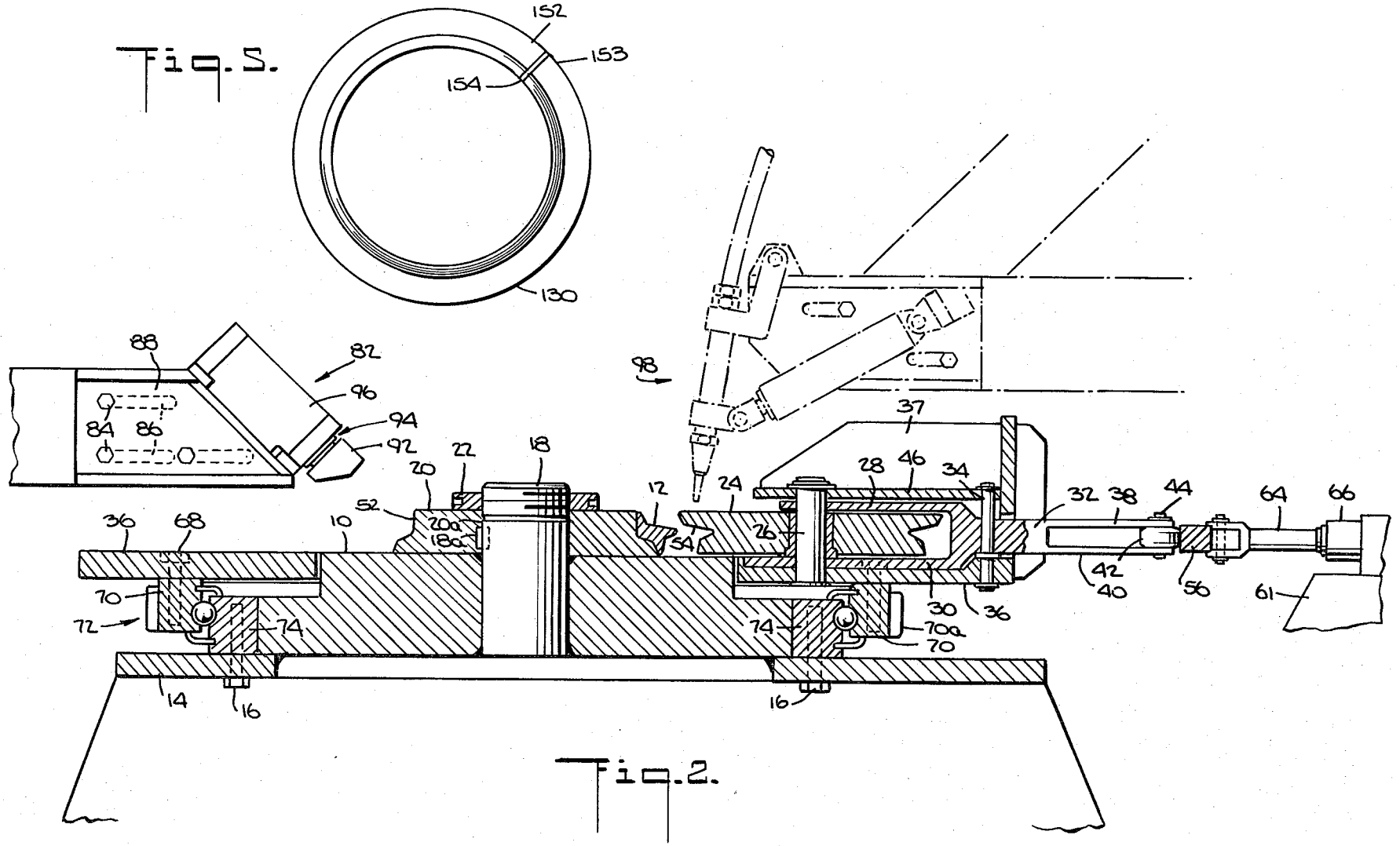
FIG. 2 is a section view taken along line 2—2 of FIG. 1.
FIG. 5 is a plan view of a completed ring formed by the apparatus of FIG. 1.
Figures 3, 4:
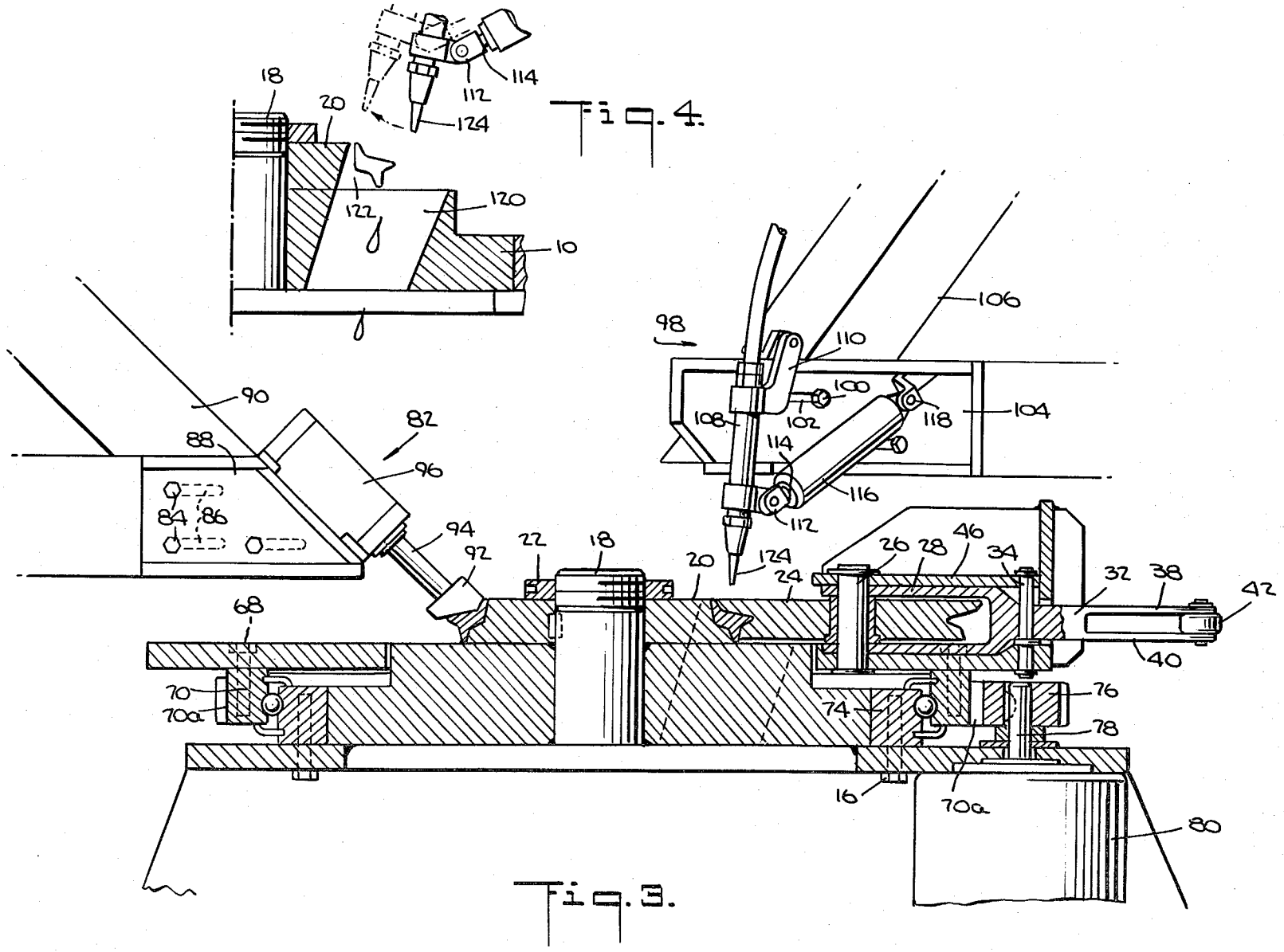
FIG. 3 is a view similar to FIG. 2 but showing the device in a different portion of its operation.
FIG. 4 is a fragmentary section view taken along line 4—4 of FIG. 1.
Figure 5:
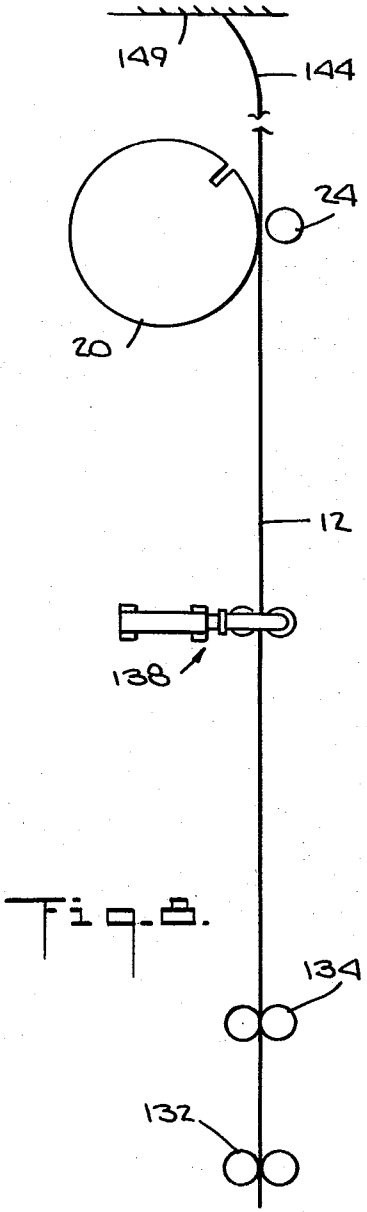

With reference to FIGS. 1, 2 and 3 together, the ring forming apparatus which is shown therein includes a circular base plate 10 which provides a bottom support surface for a piece of elongated stock 12 to be bent into a ring. The base plate 10 is welded to a bottom support 14. A threaded shaft 18 is attached to the base 10, as by welding, and extends upwardly from the center thereof. A circular mandrel 20 has a central opening 20*a* which fits over the shaft 18. The mandrel 20 is keyed to the shaft 18 by means of a key 18*a* so that it cannot rotate. A nut 22 on the threaded shaft secures the mandrel 20 to the base 10. It will be appreciated that the mandrel 20 can be easily replaced by other mandrels of different diameter and different shaped cross section for forming different diameter rings from stock of different cross section.

A bending element, such as a forming roller 24, is provided on a rotatable axle 26 held between two main prongs 28, 30 of an arm 32 (FIG. 2) which is pivotably attached by a pin 34 to a rotatable annular plate 36. Opposite the main prongs 28, 30, on the arm 32 a pair of secondary prongs 38, 40 are provided. A roller wheel 42 is attached to the arm 32 by way of a shaft 44 which extends between the secondary prongs 38, 40. The bottom of the pin 34 is attached to the plate 36 while the top is attached to an overhang 46 which is integrally a part of the plate 36. The plate 36 and the overhang 46 have curved slots 48 which serve as a guide for the upper and lower ends of the shaft 26 as the arm 32 pivots on the pin 34. Several ribs 37 are provided on the overhang 34 for structural support. A tension spring 50 extends between the outer end of the arm 32 and the edge of the plate 36 to bias the arm 32 in a counterclockwise direction so that the axle 26 is normally held to the bottom of the slot 48 as viewed in FIG. 1.

The peripheral surfaces 52, 54 of the mandrel 20 and the forming roller 24 are shaped to fit the cross sectional contour of the elongated stock 12, as can be seen in FIGS. 2 and 3. This ensures that during the bending operation the stock will not twist or deviate from a flat plane. As will be described more fully hereinafter, the mandrel 20 remains rotationally fixed but the plate 36 is driven to rotate in a counterclockwise direction as viewed in FIG. 1. The forming roller 24, as well as the arm 32, are also carried around with the plate 36 around the periphery of the stationary mandrel 20.

A cam 56 is provided at a fixed location radially outward of the plate 36 and about 45° counterclockwise of the point of initial contact of the stock 12 with the mandrel 20, as shown in FIG. 1. The cam 56 is attached at one end by a pivot pin 58 to a pivot anchor 60 on a secondary base 61 (FIG. 2) which is fixed with respect to the base 10. The other end of the cam 56 is attached by another pivot pin 62 to a shaft 64 of a reciprocating hydraulic actuator 66 also attached to the secondary base 61. When the shaft 64 of the actuator 66 is extended, as shown in phantom outline in FIG. 1, the cam 56 intersects the path of the roller wheel 42 as the arm 32 is swept past the cam 56 when the plate 36 is rotated. This causes the arm 32 to pivot against the bias of the retaining spring 50 to a disengaged position shown in dashed lines in FIG. 1. When the cam is retracted, by retraction of the shaft 64 into the actuator 66, the spring 50 returns the arm 32 to its normal, radially aligned position. It will be noted that when the arm 32 is in its solid line position as shown in FIG. 1, the forming roller 24 is brought close to the periphery of the mandrel 20 but when the arm 32 is moved to its phantom outline position the forming roller 24 is moved away from the periphery of the mandrel 20.

The rotatable plate 36 is secured by bolts 68 to the outer race 70 of a geared bearing 72, the inner bearing race 74 of which is attached to the bottom support 14. The outer race 70 has a continuous circular rack 70*a* which engages with a pinion gear 76 mounted on the end of the shaft 78 of a hydraulic motor 80 which is attached to the base. Activation of this main drive motor 80 turns the pinion gear 76 which drives the outer race 70 and thus the rotatable plate 36 to thereby move the forming roller 24 around the mandrel 20.

A clamp assembly 82 is provided above the base 10 and adjacent the mandrel 20 at a location about 135° counterclockwise from the point of initial contact of the stock 12 with the mandrel as viewed in FIG. 1. The clamp assembly 82, as shown in FIG. 2, is connected by way of bolts 84 through slots 86 on a sliding plate 88 to an overhanging arm 90. The clamp assembly 82 comprises a contact member 92, which is mounted on the end of the shaft 94 of a reciprocating hydraulic actuator 96 which is attached to the sliding plate 88. After a length of stock 12 has been bent partially around the mandrel 20 the actuator 96 extends the shaft 94 so that the contact member 92 bears against the stock 12 clamping it against movement, as shown in FIG. 3. Retracting the shaft 94, as shown in FIG. 2, releases the stock 12. By loosening the bolts 84 the clamping assembly 82 can be moved to accomodate different size mandrels 20.

A cutting torch assembly 98 is also provided above the base 10 and it is connected by way of bolts 100 through slots 102 in a sliding plate 104 to a second overhanging arm 106. The cutting torch assembly 98 comprises a plasma torch 108 the top of which is connected to the sliding plate 104 by way of a pivot arm 110. The bottom of the torch 108 is connected by way of a first pivot attachment 112 to the end of the shaft 114 of a reciprocating hydraulic actuator 116 which in turn is connected by way of a second pivot attachment 118 to the sliding plate 104.

The torch assembly 98 is positioned over a slot 120 in the base 10 which is aligned with a notch 122 in the mandrel 20. After a length of stock 12 is bent partially around the mandrel 20, the torch 108 can then be fired and the actuator 116 extended to cause the torch 108 flame to cut the stock 12. The slot 120 collects the molten slag from the cutting operation. FIG. 4 illustrates the movement of the tip 124 of the torch 108.

The several steps in the operation of the apparatus just described are illustrated in FIGS. 6 through 11. For the sake of clarity and simplicity of presentation only schematic representations of the mandrel 20, the forming roller 24 and, where appropriate, the torch 108 and clamp 82 are shown in FIGS. 6 through 11.

Figure 7:
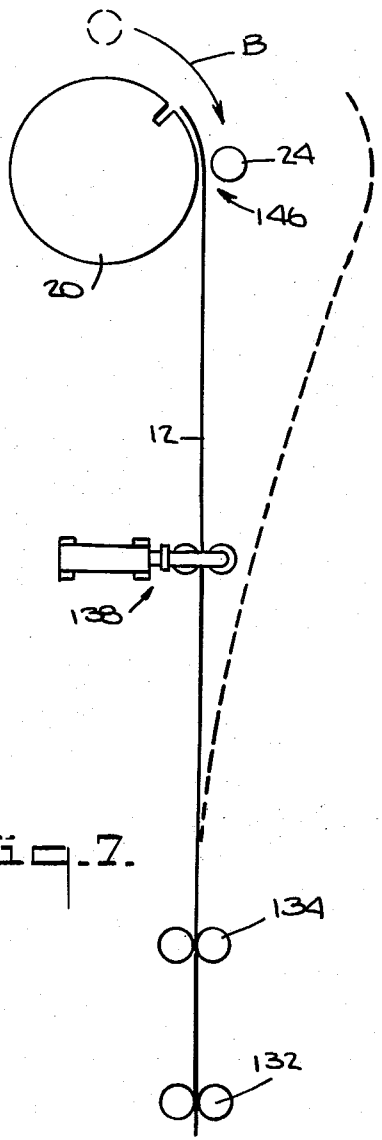
Figure 6:
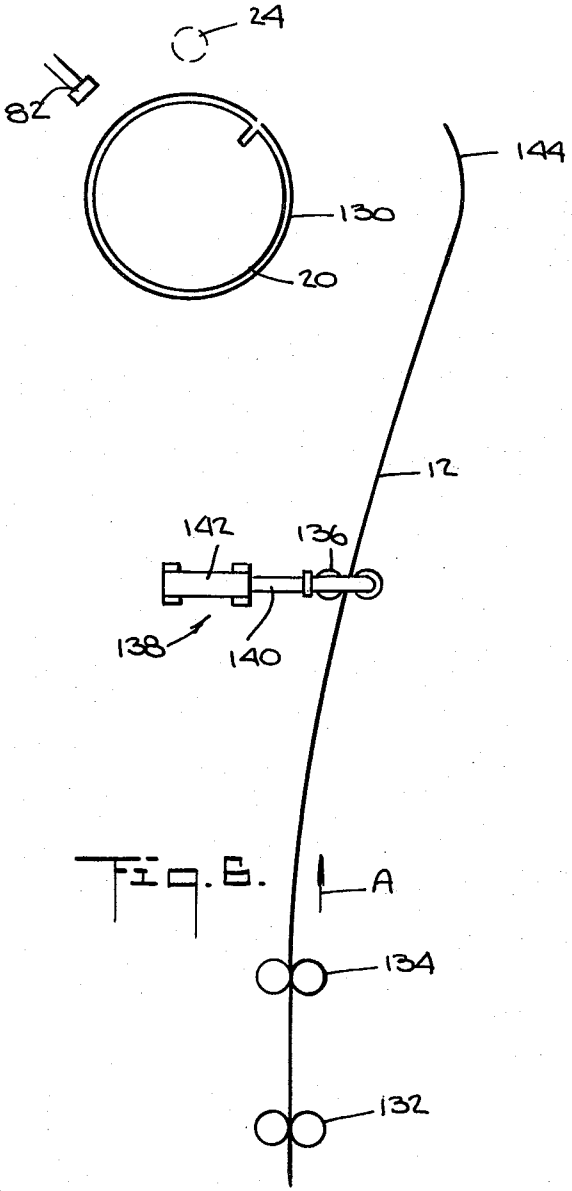

FIG. 7 represents the final step of a ring forming cycle previous to the cycle which will now be described. As shown in FIG. 6, a completed ring 130 is shown on the mandrel 20 ready to be removed before the next ring forming cycle is begun. The ring 130 is preferably removed by means of an electromagnet (not shown) of conventional construction which can be lowered onto the ring, energized, and then lifted off, carrying the ring with it. The electromagnet can then be moved to a remote location to be de-energized, thus releasing the ring and freeing the electromagnet for the next cycle. Other arrangements may be provided to remove the completed ring 130, such as levers or pins positioned in holes within the base 10 beneath the ring and capable of driven protrusion up past the surface of the base 10 to "kick" the ring 130 off the mandrel. The particular configurations of such alternatives are deemed a matter of choice and are well within the scope of those skilled in the art.

As shown in FIG. 6 the continuous elongated stock 12 is fed longitudinally in the direction of an arrow A from a source (not shown) by means of two pairs of pinch drive rollers 132, 134. The stock 12 passes between a pair of guide rollers 136, which form part of a reciprocating guide assembly 138. The guide rollers 136 are moved back and forth to move the stock 12 laterally against and away from the mandrel 20 by means of the shaft 140 of an hydraulic actuator 142.

The ring forming operation is begun with the retraction of the reciprocating guide 138 as shown in FIG. 7 to bring the end 144 of the stock 12, partially bent in a previous cycle, into contact with the mandrel 20. The main drive motor 80 (FIG. 1) is then activated to move the forming roller 24 in a clockwise direction around the mandrel 20 to a position 146 where the stock 12 contacts the mandrel 20, as shown by arrow B. As the roller 24 moves in a clockwise direction around the mandrel 20 its arm 32 disengages from the cam 56 and the spring 50 biases the roller 24 toward the mandrel 20 so that the stock 12 becomes squeezed between the roller and the mandrel.

The main drive motor 80 (FIG. 1) is stopped with forming roller 24 in position 146, and the stock 12 is then advanced longitudinally as shown in FIG. 8, through the action of the feed rollers 132, 134 by an amount substantially equal to the circumference of the ring to be formed. A contact surface 149 is located at a predetermined distance from the mandrel to be contacted by the end of the stock when it has been advanced this predetermined amount. The contact surface is connected to a pressure switch (not shown) which, when contacted by the end of the advancing stock 12, stops the feed rollers 132, 134. A second pressure switch (not shown) connected to the same contact surface simultaneously causes the retraction of cam activator 66.

Figures 9, 10, 11:
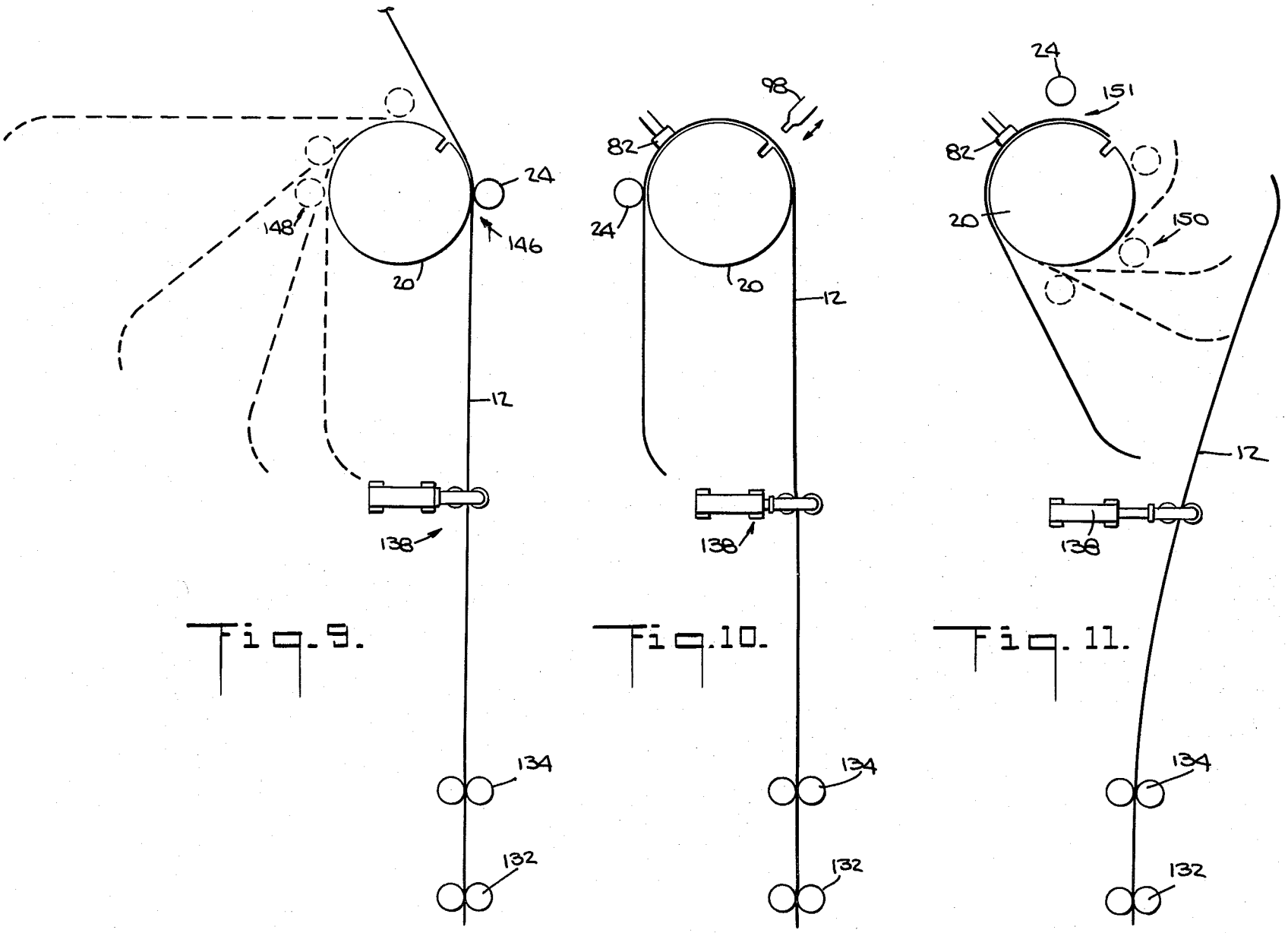

The motor 80 (FIG. 1) is then reversed to move the forming roller 24 in a counterclockwise direction as shown in FIG. 9. After the forming roller 24 has travelled approximately 180° around the mandrel 20 to an intermediate location 148 approximately opposite the location 146, the clamp 82 is then actuated, as shown in FIG. 10, to clamp the bent portion of the stock 12 against the mandrel at a location between the roller 24 and the notch 122 in the mandrel 20. The cutting torch assembly 98 is then activated to cut the stock and retracted again immediately after the cut.

The cutting torch assembly 98 is positioned at a location advanced around the periphery of the mandrel 20, in the direction of the bending, by approximately 45° from the point of initial contact of the straight portion of the stock with the mandrel 20. This ensures that the forward end of the next length to be cut from the continuous stock 12 will have been prebent by an amount is sufficient to ensure proper ring formation.

After the cutting operation is complete, the reciprocating guide 138 is extended, as shown in FIG. 11, thus shifting the continuous portion of the stock 12 laterally away from the mandrel 20 to permit completion of the formation of the ring by the continuing advancement of the roller 24 around the mandrel. Just before the roller 24 has returned to starting position 146 (FIG. 9) the cam activator 66 is extended (FIG. 1) to position the cam 56 in the path of roller 42.

The cam 56 is designed to cause the forming roller 24 to begin to lift off of the just completely formed ring 130 a small distance past the cutting notch 122. This small rolling overlap ensures proper alignment between the two ring ends 152 and 153 of ring 130.

The continuous counterclockwise advancement in conjunction with the cam action moves the forming roller into its final rest position 151 (FIG. 11) clearing the completed ring for removal as is shown in phantom lines of FIG. 1.

The main motor is then stopped, the clamp 82 is released and the thus completed ring is removed from the mandrel 20. The ends of the ring may be welded together in any suitable manner thereafter. FIG. 5 shows a completed ring 130. As can be seen the ends of the ring 152, 153 are connected by a weld 154.

The continous portion of the stock can be returned to position against the mandrel, as shown in FIG. 7, for a successive ring forming operation.

Figure 12:
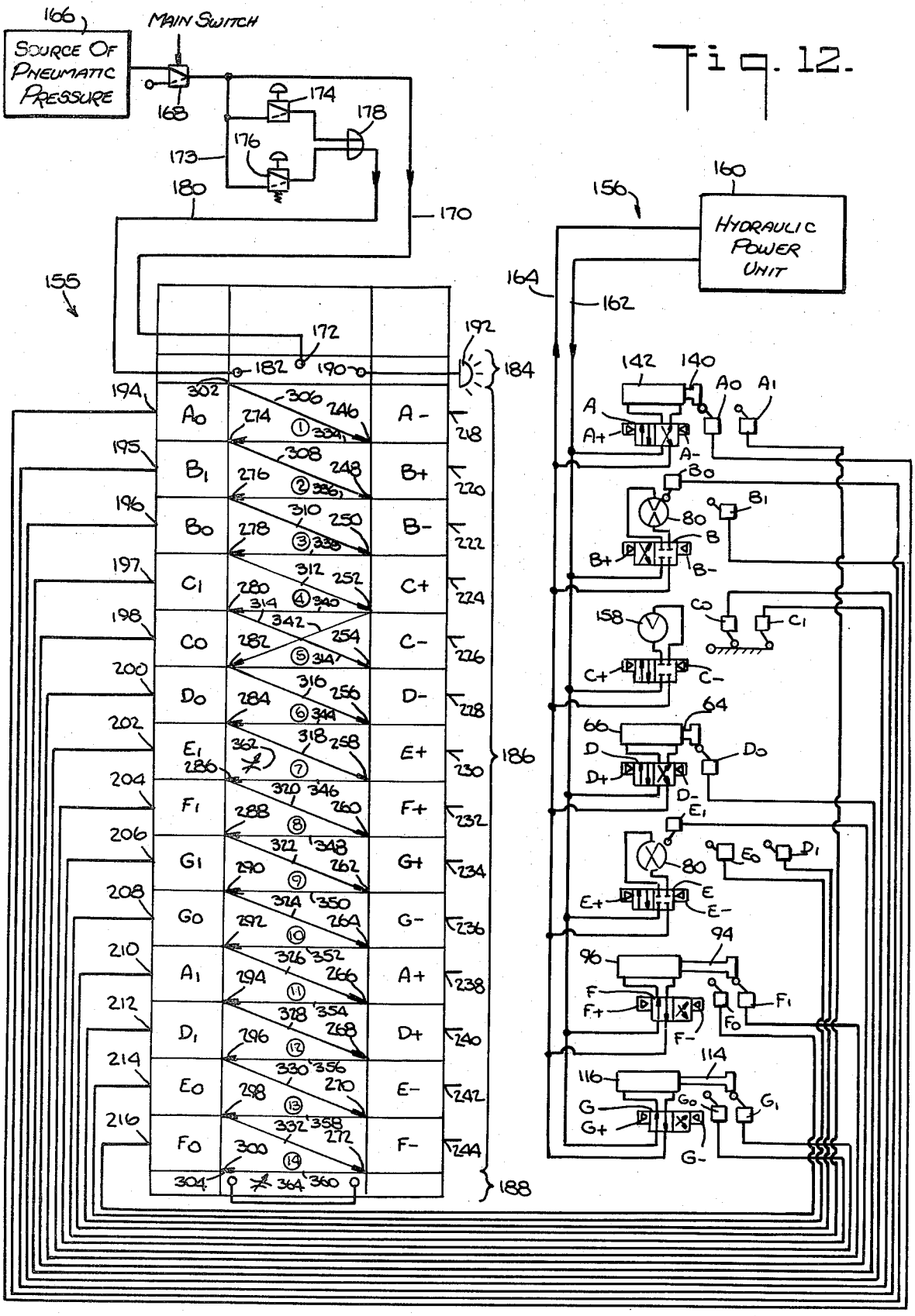
FIG. 12 is a schematic diagram of an automatic controller used for the apparatus of FIG. 1.

The apparatus of FIG. 1 is controlled for automatic operation by a programmable air controller 155 and hydraulic drive system 156 depicted schematically in FIG. 12.

The guide roller actuator cylinder 142, main drive motor 80, feed roller motor 158, cam actuator cylinder 66, clamp actuator cylinder 96 and plasma torch actuator cylinder 116 all receive drive power from a hydraulic power unit 160 through a feed line 162 and turn line 164.

Hydraulic pressure is delivered to the guide roller cylinder 142 through the action of a double air pilot-operated hydraulic valve A which connects the hydraulic lines 162 and 164 for either extension or retraction of cylinder 142 depending upon whether a pneumatic signal is present at pilot A+ or A−, respectively. This hydraulic valve A, as well as the other hydraulic valves which will be described hereinafter are standard, commercially available items, and can be obtained, for example, from Miller Fluid Power Corporation, 7N015 York Road, Bensenville, Ill. 60106.

The main drive motor 80 is powered to advance the forming roller 24 (FIGS. 1–3) clockwise or stop the roller 24 movement, depending upon whether a pneumatic signal is present at pilot B+ or B− of valve B, respectively, or to reverse the motor 80 in a counterclockwise direction or stop the movement depending upon whether a pneumatic signal is present at pilot E+ or E− of valve E, respectively.

The feed roller motor 158 is powered when a pneumatic signal is present at pilot C+ of valve C, and receives no power when a signal is present at pilot C−.

Valves D, F and G control the cam actuator cylinder 66, the clamp actuator cylinder 96 and the torch actuator cylinder 116, respectively. In each case a pneumatic signal at the associated + pilot extends the actuator, while a signal at the − pilot retracts the actuator. Thus, a pneumatic signal at pilot D+ extends cylinder 66, etc.

Limit switches A0 and A1 are placed so as to be tripped when the shaft 140 of the guide roller cylinder 142 retracts or extends, respectively. The outputs of switches A0 and A1, as well as the outputs of the other limit switches, which will be described below, are connected to the programmable controller 155 in a manner which will be described hereinafter.

Limit switches B0, B1, E1, D1 and E0 are positioned at different locations around the rotatable plate 36 (FIGS. 1–3), to be tripped by one or more protrusions (not shown) from the plate 36, the relative positions of the switches and protrusions being determined as follows. Switch B1 is positioned to trip just before the forming roller 24 reaches location 146 in its clockwise motion (FIG. 7): Switch B0 is positioned to trip when forming roller 24 actually reaches location 146 (FIG. 7). Switch E1 is positioned to trip when the forming roller 24 passes the clamp 82 location (FIG. 10), switch D1 is positioned to trip just before the forming roller 24 reaches the final position 151, and switch E0 is positioned to trip when the forming roller 24 actually reaches the final position 151 (FIG. 11).

Limit switches C0 and C1 are connected to the contact surface 149 (FIG. 8) and are both tripped by the force of contact of the advancing stock 12.

The shafts of the cylinders for the cam actuator 66, the clamp actuator 96 and the torch actuator 116 each have two associated limit switches, those tripped by retraction being designated by "0" and those tripped by extension being designated by "1". The letters "D", "F" and "G" identify the switches associated with the cam actuator 66, clamp actuator 96 and torch actuator 116, respectively. Thus, for example, switch F1 trips when the clamp actuator 96 extends, and so forth. The only exception is valve D1 which was described above.

The programmable air controller 155 is provided with pneumatic pressure from a source 166 through a main switch 168. The output of switch 168 is divided into two lines. One line 170 provides supply pressure to the controller 155 through an entry port 172, while the other line 173 provides a temporary pressure signal for starting an operation cycle and, in continuous cycle operation, provides continuous pressure to start successive cycles. One cycle operation is selected by way of a one cycle switch valve 176 which is spring loaded and thus returns to the off state when released. Continuous operation is selectd by way of a continuous cycle switch valve 174 that remains on after being tripped. The outputs of switch valves 174 and 176 are connected to the input ports of an OR element 178. The output of OR element 178 is connected to a line 180 which is connected to the start port 182 of the connector 155.

The entry port 172 and start port 182 are two of three ports provided in an entry module 184 which is the first of a series of modules which together make up the entire controller 155. The third port of the entry module is an indicator port 190 which provides an output pressure signal when the controller 155 is pressurized for operation. An indicator 192 connected to port 190 provides a visual indication of the pressurized state. The other modules are program modules 186 and an exit module 188, which are described hereinafter. All of the modules are commercially available from the Miller Fluid Power Corporation, mentioned above, and their operation is described in a publication entitled "Programmable Air Controller", copyright 1978 Miller Fluid Power Corporation, Bulletin No. 6399-379.

The air controller of the preferred embodiment of the present invention uses fourteen program modules 1–14. Each program module has a limit switch input port 194–216 an output port 218–244, a module set input port 246–272 and a module set output port 274–300.

Each of the limit switch input ports 194–216 is connected by a pneumatic line to one of the limit switches A0, A1, etc., as shown in FIG. 12. Each of the output ports 218–244 is connected to an input port of one of the double air pilot operated hydraulic valve A–G described above. For the sake of clarity of illustration these lines are not shown in FIG. 12; instead, the hydraulic valve port reference to which the output port is connected is shown at the right side of the module adjacent the output port. Thus, for example, output port 218 of module 1 is connected to pilot A− of hydraulic valve A.

The module set input port 246 of module 1 is connected to an output port 302 of the entry module 184. An output signal appears at output port 302 when a start signal is applied to the start port 182, and this output signal is thus applied to the set input port 246 of module 1.

In the cases of modules 1–13 each module set output port 274–298 is applied to the module set input port 248–272 of the next module. Thus, for example module set output port 274 of module 1 is connected to module set input port 248 of module 2, etc. The module set output port 300 of module 14 is connected to the input port 304 of exit module 188. The exit module 188 is connected so as to cause module 1 to initiate another cycle in response to a signal applied to input port 304 of the exit module 188, if a start signal is present at start port 182. When the controller 155 is first turned on, the operation is initiated simply by causing a signal to appear at start port 182, by switching switch 174 or 176 ON.

Referring to module 2 for example, the operation sequence of each of the program modules 186 proceeds in the following manner. When a signal appears at the module set input port 248 from the previous module 1, a signal is caused to appear at the output port 220. Because this output port 220 is connected to pilot B+, the main drive motor 80 is thereby activated to rotate clockwise until limit switch B1 is tripped as described above. The tripping of switch B1 causes a signal to be applied to limit switch input port 195 of module 2. The appearance of the signal at port 195 causes a signal to appear at the module set output port 276 and thus be applied to the module set input port 250 of the next module 3. This starts the operation sequence of module 3, and so forth.

The left-to-right arrows 306–332 in each module 1–14 depict the flow of signal to command in the controller 155 operation, while the right-to-left arrows 334–360 depict the flow of command to signal. Thus, for example, arrow 306 shows that the start signal at port 302 triggers the A−, or "retract guide roller" command, and arrow 334 shows that the retraction of the guide cylinder eventually triggers limit switch A0, which in turn, as shown by arrow 308, triggers the B+, or "main drive motor clockwise" command, and so forth.

Two of the modules, 7 and the exit module 188, have adjustable timers 362 and 364, respectively, associated therewith. The timers 362, 364 operate to delay the time the module output appears after the receipt of a module set signal. Thus, with respect to module 7, after a module set signal appears at port 258, by virtue of the triggering of limit switch D0, E+ will be commanded by way of an output at port 230 only after the set delay of timer 362. The same considerations apply to the exit module 188.

The automatic, continuous cycle operation of the apparatus of FIG. 1 will now be described, by reference to FIGS. 1 and 6–12 together. The guide roller actuator 142 is initially in extended configuration (FIG. 6) and a length of stock 12 prebent from a previous cycle is held between guide rollers 136 away from the mandrel 20 to permit removal of the completed ring 130 from the previous cycle. The forming roller 24 is initially fully pivoted away from the mandrel 20.

The main switch valve 168 is turned ON (FIG. 12), thus powering the controller 155 through port 172, and activating indicator 192. The continuous cycle switch 174 is then switched on applying a signal to start port 182 causing module 1 to apply a signal to pilot A− thereby commanding retraction of the guide roller actuator shaft 140, and thus of the guide rollers 136 (FIG. 7) bringing the stock 12 into contact with the mandrel 20.

Retraction of the guide roller actuator shaft 140 trips switch A0 (FIG. 12) which triggers module 2 to apply a signal to pilot B+, thereby commanding advance drive of the main drive motor 80, and thus producing clockwise motion of the forming roller 24. This causes the cam wheel 42 to disengage from the cam (FIG. 1), in turn causing the pivot arm 32 to pivot, bringing the forming roller 24 toward the mandrel 20 (FIG. 7).

Just before the forming roller 24 reaches position 146 limit switch B1 is tripped (FIG. 12) which triggers module 3 to apply a signal to pilot B− cutting off the drive power to main drive motor 80 which then coasts a slight distance to position 146 (FIG. 7) at which point limit switch B0 is tripped (FIG. 12). The signal from switch B0 causes module 4 to apply a signal to pilot C+, thereby commanding the feed roller motor 158 to operate and thus feeding the stock 12 forward (FIG. 8).

When the end 144 of the stock 12 travels a distance substantially equal to the circumference of the ring 130 to be formed it contacts contact surface 149 thus tripping limit switches C1 and C0 (FIG. 12). Simultaneously, modules 5 and 6 are thereby caused to apply signals to pilots C− and D−, respectively. The signal at pilot C− causes the feed roller motor 158 to stop, and the signal at pilot D− causes the cam activator shaft 64 to retract (FIG. 1) clearing the way for a bending operation.

The retraction of the cam actuator shaft 64 trips limit switch D0 (FIG. 12) which triggers module 7 to apply a signal to pilot E+ thereby commanding reverse drive of the main drive motor 80, thus driving the forming roller 24 (FIG. 9) around the mandrel 20 in a counterclockwise direction. Note that by virtue of the parallel control of valves B and E (FIG. 12) over the main motor 80, referred to above, two separate motion commands are possible within the program.

As the forming roller 24 passes the clamp 82 location (FIG. 10) limit switch E1 is tripped, thus triggering adjustable timer 362. Adjustable timer 362 is set with a delay sufficient to allow the forming roller 24 to completely pass the clamp 82. After the delay time, the timer 362 triggers the module 8 to apply a signal to pilot F+ causing the cam actuator shaft 94 to extend the clamp 82 (FIG. 10), clamping the stock 12 against the mandrel 20.

The extension of the cam actuator shaft 94 trips limit switch F1 (FIG. 12) which triggers module 9 to apply a signal to pilot G+ thereby commanding extension of the plasma torch actuator shaft 114 thus causing the stock 12 to be cut (FIG. 10) by the flame of the torch 98.

The extension of the torch shaft 114 trips limit switch G1 (FIG. 12) which triggers module 10 to apply a signal to pilot G− thereby commanding retraction of the torch shaft 114 (FIG. 10) and thus withdrawing the flame immediately after the cut.

The retraction of the torch shaft 114 trips limit switch G0 (FIG. 12) which triggers module 11 to apply a signal to pilot A+ thereby commanding extension of guide rollers actuator shaft 140, thus shifting the remaining end of the stock 12 (FIG. 11) laterally away from the mandrel 20 to permit the completion of the bending operation.

The extension of the guide roller shaft 140 trips limit switch A1 (FIG. 12) which triggers module 12 to apply a signal to pilot D+ thereby commanding extension of the cam actuator shaft 64 so that the cam roller 42 (FIG. 1) will contact the cam 56 as the pivot arm 32 is swept by the cam 56, thus pivoting the forming roller away from the mandrel 20 (FIG. 11).

Just before the forming roller reaches position 151 limit switch D1 is tripped (FIG. 12) which triggers module 13 to apply a signal to pilot E− cutting off power to the main drive motor 80 which then coasts a slight distance to position 151 (FIG. 11) at which point limit switch E0 is tripped.

The signal from limit switch E0 triggers module 14 to apply a signal to pilot F− thereby commanding the clamp actuator shaft 94 to retract (FIG. 6) allowing the completed ring 130 to be removed as described above.

The retraction of the clamp actuator shaft 94 trips limit switch F0 (FIG. 12) which triggers the adjustable timer 364 associated with the exit module 188. Timer 364 is set with a delay sufficient to allow the ring to be removed. After the delay time set in timer 364 has passed, module 1 is activated to start the sequence again if a signal is present at the start port 182 which is the case if the continuous cycle switch 174 has been tripped.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

I claim:

1. A method for forming a ring from an elongated bar of continuous stock comprising the steps of:

positioning the stock against a cylindrical mandrel having a predetermined cutting location on the periphery thereof, the lead end of the stock being curved from bending in a previous operation cycle;

positioning a forming element against the stock at a first position where the stock contacts the mandrel;

bending the stock partway around the mandrel by advancing the forming element around the mandrel to a second location past said cutting location;

clamping the stock against the mandrel at a predetermined clamping location between said second location and said cutting location;

cutting the stock at said cutting location so that the stock clamped against the mandrel is free of the continuous stock and so that a bend is left in the end of the continuous stock;

positioning the continuous stock away from said mandrel to permit the continued bending of the stock clamped against said mandrel without obstruction; and further bending the stock clamped against the mandrel by further advancing the forming element around the mandrel to a third position until the lead end of said stock is brought adjacent to its cut end.

2. A method according to claim 1 wherein said step of further bending the stock is performed by allowing the forming element to pass over both ring ends to assure proper ring end alignment.

3. A method according to claim 1, wherein said step of positioning the stock against the mandrel is performed by positioning the stock so that the curved end contacts the mandrel along its curve, and wherein the method comprises the further step, after said step of positioning the stock against the mandrel, of advancing the stock in the direction of its linear axis by a predetermined amount.

4. A method according to claim 2 wherein said step of advancing is performed by advancing the stock by an amount substantially equal to the circumference of said mandrel.

5. A method according to claim 1, wherein said cutting location is on the periphery of said mandrel advanced from said point first contact of said stock with said mandrel in the direction of the bending operation by an angle with respect to the center of said mandrel of approximately 45°, and wherein said step of bending said stock partway around said mandrel is performed by advancing said forming element around said mandrel by an angle with respect to the center of said mandrel of approximately 180°.

6. A method according to claim 1, further comprising the step of removing the ring from said mandrel following completion of movement of said forming element around said mandrel.

7. A method according to claim 1, further comprising the step of preventing the stock from advancing while said forming element is advancing.

* * * * *